US009566468B2

(12) United States Patent
Crist

(10) Patent No.: US 9,566,468 B2
(45) Date of Patent: Feb. 14, 2017

(54) SYSTEM, METHOD, AND APPARATUS FOR BALANCE TRAINING EXERCISE

(71) Applicant: Brian Crist, Virginia Beach, VA (US)

(72) Inventor: Brian Crist, Virginia Beach, VA (US)

( * ) Notice: Subject to any disclaimer, the term of this patent is extended or adjusted under 35 U.S.C. 154(b) by 0 days.

(21) Appl. No.: 14/601,583

(22) Filed: Jan. 21, 2015

(65) Prior Publication Data

US 2015/0251056 A1 Sep. 10, 2015

Related U.S. Application Data

(60) Provisional application No. 61/948,056, filed on Mar. 5, 2014.

(51) Int. Cl.

| | |
|---|---|
| ***A63B 26/00*** | (2006.01) |
| ***A63B 22/18*** | (2006.01) |
| ***A63B 22/16*** | (2006.01) |

(52) U.S. Cl.

CPC ..... *A63B 22/18* (2013.01); *A63B 22/16* (2013.01); *A63B 26/003* (2013.01); *A63B 2225/62* (2013.01)

(58) Field of Classification Search

CPC ..... A63B 22/18; A63B 22/16; A63B 2225/62
See application file for complete search history.

(56) References Cited

U.S. PATENT DOCUMENTS

| | | | | |
|---|---|---|---|---|
| 2,764,411 | A * | 9/1956 | Washburn, Jr. | A63B 22/16 280/1 |
| 4,601,469 | A * | 7/1986 | Sasser, Jr. | A63B 22/16 482/146 |
| 6,602,172 | B1 * | 8/2003 | Aigner | A63B 21/0004 482/147 |
| 6,872,175 | B2 * | 3/2005 | Lin | A63B 21/0004 482/121 |
| 6,916,276 | B1 * | 7/2005 | Robinson | A63B 22/16 482/147 |
| 7,134,990 | B2 * | 11/2006 | Wischusen | A63B 21/0004 441/74 |
| 7,300,392 | B1 * | 11/2007 | Curran | A63B 21/0004 482/146 |
| 7,479,097 | B2 * | 1/2009 | Rosborough | A63B 22/16 446/396 |
| 7,857,740 | B2 * | 12/2010 | Suaste | A63B 21/0004 482/142 |

(Continued)

*Primary Examiner* — Loan T Thanh
*Assistant Examiner* — Megan Anderson
(74) *Attorney, Agent, or Firm* — Hayes Soloway PC

(57) ABSTRACT

A system for balance training exercise comprises a rigid balance board having a substantially planar top surface. First and second rails are positioned on a bottom surface of the balance board, substantially opposite each other. A nose cap is positioned on a front end of the balance board. A tail cap is positioned on a rear end of the balance board. A bottom surface of the first and second rails, the nose cap, and the tail cap are substantially co-planar. A nose stop is positioned on the nose cap and a tail stop is positioned on the tail cap, wherein the nose and tail stops extend beyond the bottom surface of the nose and tail caps, respectively. A balance device is removably positioned in contact with the bottom surface of the balance board or the bottom surface of the first and second rail, the nose cap, and the tail cap.

20 Claims, 8 Drawing Sheets

(56) References Cited

U.S. PATENT DOCUMENTS

| | | | | |
|---|---|---|---|---|
| 7,942,797 | B1 * | 5/2011 | Canton | A63B 22/16 482/146 |
| 8,062,199 | B2 * | 11/2011 | Smith | A63B 21/0004 482/146 |
| 2006/0270536 | A1 * | 11/2006 | Tukada | A63B 26/003 482/146 |

* cited by examiner

SYSTEM, METHOD, AND APPARATUS FOR BALANCE TRAINING EXERCISE

CROSS REFERENCE TO RELATED APPLICATION

This application claims benefit of U.S. Provisional Application Ser. No. 61/948,056, entitled, "ISO Board Balance Training System" filed Mar. 5, 2014, the entire disclosure of which is incorporated herein by reference.

FIELD OF THE DISCLOSURE

The present disclosure is generally related to exercise training systems and more particularly is related to a system, method, and apparatus for balance training exercise.

BACKGROUND OF THE DISCLOSURE

A balance board is a device used for recreation, balance training, athletic training, brain development, therapy, and other kinds of personal development. Use of balance boards may aid in developing fine motor skill and balance in humans. Balance boards typically include an elongated board having a length that is greater than a width, and a pivot mechanism. Usually the pivot mechanism is a cylinder that can roll by rotating about a central roll axis, which defines the pivot axis of the board. Most balance boards are adapted for balancing by a rider in which the board is positioned with its length latitudinal or transverse to the longitudinal or roll axis of the cylinder supporting the balance board. Conventional balance boards generally provide a single axis on which the device will balance and have been in use for many years. However, these conventional balance boards fail to provide the user with a dynamic, user-selectable, or multi-functional graduated system for strength and balance training. As a result, these conventional devices often fail to accurately replicate the conditions of the underlying board sport.

Thus, a heretofore unaddressed need exists in the industry to address the aforementioned deficiencies and inadequacies.

SUMMARY OF THE DISCLOSURE

Embodiments of the present disclosure provide an apparatus for balance training exercise. Briefly described, in architecture, one embodiment of the system, among others, can be implemented as follows. The apparatus includes a rigid balance board having a substantially planar top surface. A first rail and a second rail are positioned on a bottom surface of the balance board, wherein the first rail is positioned substantially opposite the second rail. A nose cap is positioned on a front end of the balance board. A tail cap is positioned on a rear end of the balance board, wherein a bottom surface of the first rail, the second rail, the nose cap, and the tail cap are substantially co-planar. A nose stop is positioned on the nose cap and a tail stop is positioned on the tail cap, wherein each of the nose stop and tail stop extend beyond the bottom surface of the nose cap and tail cap, respectively.

The present disclosure can also be viewed as providing a system for balance training exercise. Briefly described, in architecture, one embodiment of the system, among others, can be implemented as follows. A rigid balance board has a substantially planar top surface. A first rail and a second rail are positioned on a bottom surface of the balance board, wherein the first rail is positioned substantially opposite the second rail. A nose cap is positioned on a front end of the balance board. A tail cap is positioned on a rear end of the balance board, wherein a bottom surface of the first rail, the second rail, the nose cap, and the tail cap are substantially co-planar. A nose stop is positioned on the nose cap and a tail stop is positioned on the tail cap, wherein each of the nose stop and tail stop extend beyond the bottom surface of the nose cap and tail cap, respectively. At least one balance device is removably positioned in contact with at least one of: the bottom surface of the balance board and the bottom surface of the first rail, the second rail, the nose cap, and the tail cap.

The present disclosure can also be viewed as providing methods for balance training exercise. In this regard, one embodiment of such a method, among others, can be broadly summarized by the following steps: positioning at least one balance device underneath a rigid balance board, the rigid balance board having a substantially planar top surface, a first rail and a second rail positioned on a bottom surface of the balance board, wherein the first rail is positioned substantially opposite the second rail, a nose cap positioned on a front end of the balance board, a tail cap positioned on a rear end of the balance board, wherein a bottom surface of the first rail, the second rail, the nose cap, and the tail cap are substantially co-planar, and a nose stop positioned on the nose cap and a tail stop positioned on the tail cap, wherein each of the nose stop and tail stop extend beyond the bottom surface of the nose cap and tail cap, respectively; and balancing a user on the substantially planar top surface of the rigid balance board.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
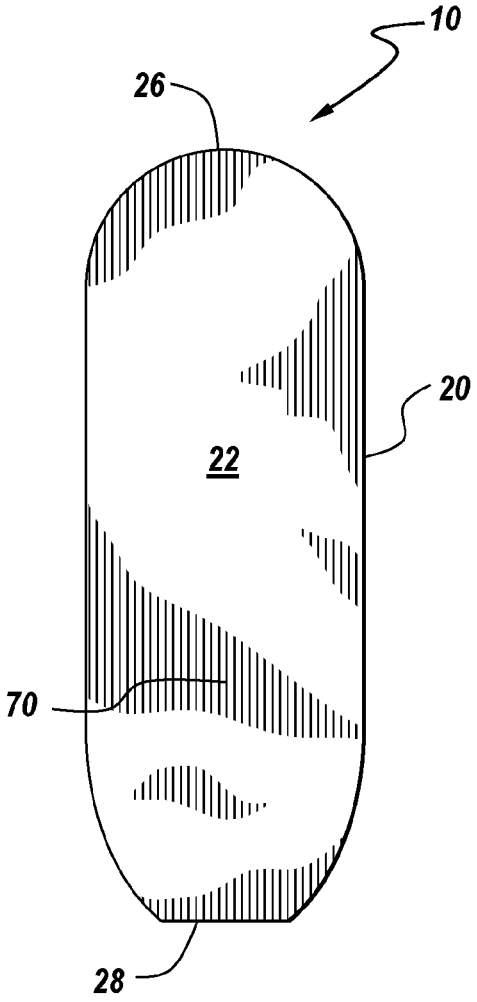
FIG. 1 is a top view illustration of a balance board, in accordance with a first exemplary embodiment of the present disclosure.
Figure 2:
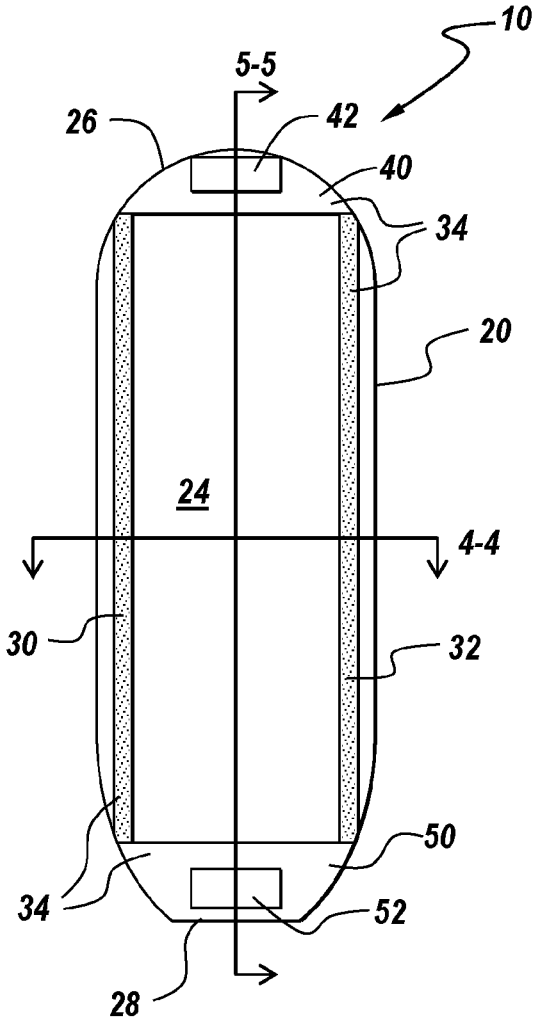
FIG. 2 is a bottom view illustration of the balance board of FIG. 1, in accordance with the first exemplary embodiment of the present disclosure.

FIG. 1 is a top view illustration of a balance board 20, in accordance with a first exemplary embodiment of the present disclosure. FIG. 2 is a bottom view illustration of the balance board 20 of FIG. 1, in accordance with the first exemplary embodiment of the present disclosure. The balance board 20 may be a component of an apparatus for balance training exercise apparatus 10, referred to herein simply as 'apparatus 10'. The apparatus 10 includes the rigid balance board 20 having a substantially planar top surface 22. A first rail 30 and a second rail 32 are positioned on a bottom surface 24 of the balance board 20, wherein the first rail 30 is positioned substantially opposite the second rail 32. A nose cap 40 is positioned on a front end 26 of the balance board 20. A tail cap 50 is positioned on a rear end 28 of the balance board 20, wherein a bottom surface 34 of the first rail 30, the second rail 32, the nose cap 40, and the tail cap 50 are substantially co-planar. A nose stop 42 is positioned on the nose cap 40 and a tail stop 52 positioned on the tail cap 50, wherein each of the nose stop 42 and tail stop 52 extend beyond the bottom surface 34 of the nose cap 40 and tail cap 50, respectively.

The apparatus 10 is a device and system, and corresponding method, which can be used for balance and strength training. Specifically, the apparatus 10 may be used to train for board-based sports including stand-up paddle boarding, surfing, skateboarding and other board sports that require balance. Users may gain significant benefits, such as improvement in balance, gained strength, and/or increased conditioning, from the beginner to the professional level. The apparatus 10 may effectively replicate most board sports, in general, such as surfing, skateboarding snowboarding, and wakeboarding. The apparatus 10, in particular, replicates stand up paddle boarding.

The rigid balance board 20 may have an elongated, curved rectangular shape that has a length greater than its width. The shape of the balance board 20 may include a rounded or pointed section corresponding to the front end 26 of the board 20, with flattened or "squash tail" shape at the rear end 28 or tail of the board 20. These shapes may aid the user in identifying the front end 26 and rear end 28 of the board 20, as well as enhance the rider's experience and realism relative to the sport of choice, in using the apparatus 10. The rear end 28 having the flattened shape may be designed to fit into a retaining base to securely support the board 20 when not in use. Apart from graphic designs placed on a surface of the board 20, the board 20 may be substantially symmetrical between a left and right side. The board 20 may be formed from a durable, substantially rigid material, such as hardwood, plastics, cured resins, metals, or other materials. The size of the board 20 may vary, but it may generally have a height, between the front end 26 and rear end 28, of approx. 38 inches and a width between the left and right sides of approx. 14 inches. Any sizes, shapes, or materials of the board 20 are considered within the scope of the present disclosure.

The board 20 has a substantially planar top surface 22, shown clearly in FIG. 1. The top surface 22 may have a traction coating 70 or traction enhancing material applied thereto. The traction coating 70 may include silica or a similar material impregnated in a resin, or another protective finish to provide a non-slip traction area for the user to be able to move about the board 20 without losing traction with the top surface 22. The traction coating 70 may allow the user to securely perform movements on the board 20 similar to the sport of choice being simulated. The traction coating 70 may be applied to the top surface 22 in a variety of ways, including any industry standard methods, for example, by brushing, spraying, gluing, or molding the traction coating 70 to the top surface 22, among other common application techniques. The edges of the board 20 may be left smooth and slightly rounded to prevent catching or snagging on the user's hands when the board 20 is in use.

As is shown in FIG. 2, the first rail 30 and the second rail 32 are positioned on a bottom surface 24 of the board 20. The first rail 30 is positioned substantially opposite the second rail 32, such as the first rail 30 being positioned proximate to a left side of the board 20 and the second rail 32 being positioned proximate to a right side of the board 20. Each of the first and second rails 30, 32 may be positioned slightly inset or a spaced distance from an edge of the board 20. Each of the first and second rails 30, 32 may be affixed to the bottom surface 24 of the board 20 by a variety of devices and methods, including fasteners, glues, affixment processes, or any combination thereof. Each of the first and second rails 30, 32 may extend away from the bottom surface 24 of the board 20, thereby creating a raised rail structure on either side of the board 20.

The nose cap 40 is positioned on the front end 26 of the board 20 and the tail cap 50 is positioned on the rear end 28 of the board 20. Each of the nose and tail cap 40, 50 may be affixed to or formed integrally with the end of the board 20, wherein each of the nose and tail cap 40, 50 extend away from the bottom surface 24 of the board 20, similar to the first and second rails 30, 32. The height of the first rail 30, the second rail 32, the nose cap 40, and the tail cap 50 may vary, depending on design. In one example, the height may be approx. ½ inch, but other heights and sizes are considered within the scope of the present disclosure. The bottom surface 34 of each of the first rail 30, second rail 32, nose cap 40, and tail cap 50 may be substantially coplanar with one another. The exposed portion of the bottom surface 24 of the board 20 may be a center cavity positioned between the first rail 30, the second rail 32, the nose cap 40, and the tail cap 50. The remaining exposed portion of the bottom surface 24 of the board 20 may be positioned external of the first and second rails 30, 32, and thus not be part of the center cavity formed between the first rail 30, the second rail 32, the nose cap 40, and the tail cap 50.

The nose stop 42 is positioned on the nose cap 40 and extends beyond the bottom surface 34 of the nose cap 40, and the tail stop 52 is positioned on the tail cap 50 and extends beyond the bottom surface 34 of the tail cap 50. Accordingly, each of the nose stop 42 and tail stop 52 may have a height greater than the nose and tail caps 40, 50, respectively, although the heights of the nose and tail stops 42, 52 need not match. The shape and size of the nose and tail stop 42, 52 may vary depending on design. As is shown in FIG. 2, the nose and tail stop 42, 52 may each be positioned a spaced distance from an internal edge of the nose and tail cap 40, 50, respectively. The nose and tail stop 42, 52 may also each be substantially centered on the nose and tail cap 40, 50, respectively. In one example, the nose stop 42 and the nose cap 40 may share a front edge, e.g., proximate to the front edge of the board 20. The front edge shared between the nose stop 42 and the nose cap 40 may form a small, acute angle relative to the substantially planar top surface 22 of the board 20. Similarly, the tail stop 52 and the tail cap 50 may share a common rear edge, wherein the rear edge forms a small or acute angle relative to the substantially planar top surface 22 of the board 20. The acute angle of the front or rear edge, respectively, may minimize contact between the apparatus 10 and the ground surface when the board 20 pivots on the balance device. The first and second rails 30, 32, the nose cap 40, the tail cap 50, the nose stop 42, and the tail stop 52 may be formed from a durable, substantially rigid material, such as hardwood, plastics, cured resins, metals, or other materials.

The apparatus 10, as described in FIGS. 1-2, may be used with a variety of balance devices which are placed below the board 20. The user of the board 20 may stand or otherwise occupy the top surface 22 of the board 20 balancing on the balance device. Further details of the board 20, the balance devices, and other features of the present disclosure are provided relative to FIGS. 1-11, herein.

Figure 3A:
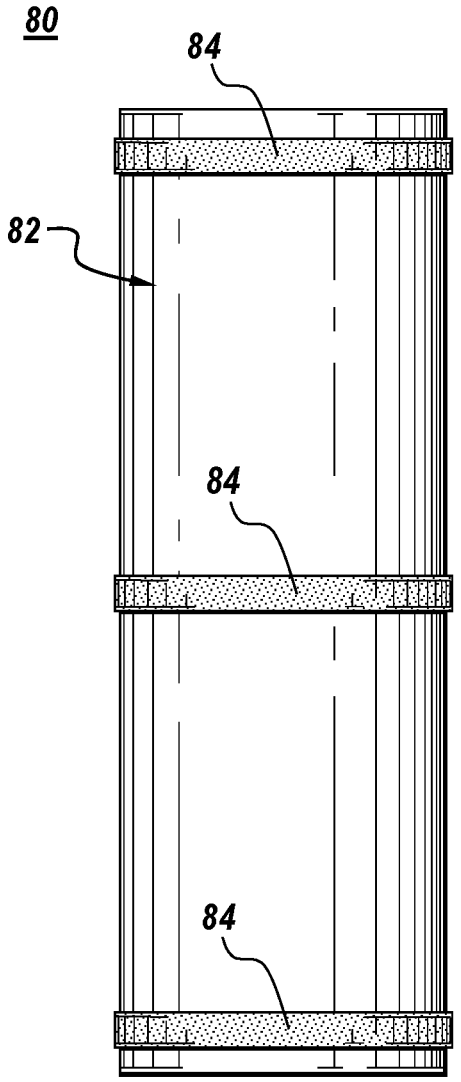
FIG. 3A is a top view illustration of a cylindrical balance tube, in accordance with the first exemplary embodiment of the present disclosure.
Figure 3B:
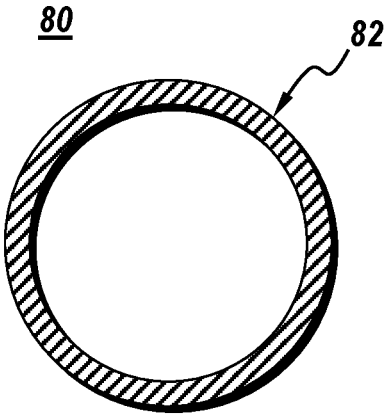
FIG. 3B is a cross-sectional side view illustration of a cylindrical balance tube, in accordance with the first exemplary embodiment of the present disclosure.

FIGS. 3A-3B illustrate one example of a balance device 80 which can be used with the apparatus 10. Specifically, FIG. 3A is a top view illustration of a cylindrical balance tube 82, in accordance with the first exemplary embodiment of the present disclosure and FIG. 3B is a cross-sectional side view illustration of a cylindrical balance tube 82, in accordance with the first exemplary embodiment of the present disclosure. The cylindrical balance tube 82 may be a cylindrically-shaped tube or structure which is durable and sturdy enough to support the weight of the board 20 and the user thereon. The cylindrical balance tube 82 is preferably made from a rigid or semi-rigid material that is hard and durable, such as a plastic, wood, glass, fiberboard, aluminum, steel or similar material. The cylindrical balance tube 82 is preferably hollow and may have varying lengths and diameters. For example, cylindrical balance tubes 82 may include diameters of 2.5 inches to 8.5 inches and lengths of 10-30 inches, or any other size. Preferably, the cylindrical balance tube 82 has a length dimension less than a distance between the nose cap 40 and the tail cap 50 (FIGS. 1-2).

The cylindrical balance tube 82 may have a traction material 84 positioned axially about the exterior surface of the cylindrical balance tube 82. The traction material 84 may include durable traction rings positioned at right angles relative to the length of the cylindrical balance tube 82, and may be situated near the ends and/or near the middle of the cylindrical balance tube 82, or any combination thereof. The traction material 84 may also include a thin grip tape or similar material. The traction material 84 may aid in providing traction between the riding surface, e.g., a floor or carpeted surface, and the cylindrical balance tube 82 thus inhibiting slippage between the two surfaces. The ring-shaped traction material 84 may allow for a small amount of compressive relief between the cylindrical balance tube 82, board 20 (FIGS. 1-2), and the riding surface.

Figure 4:
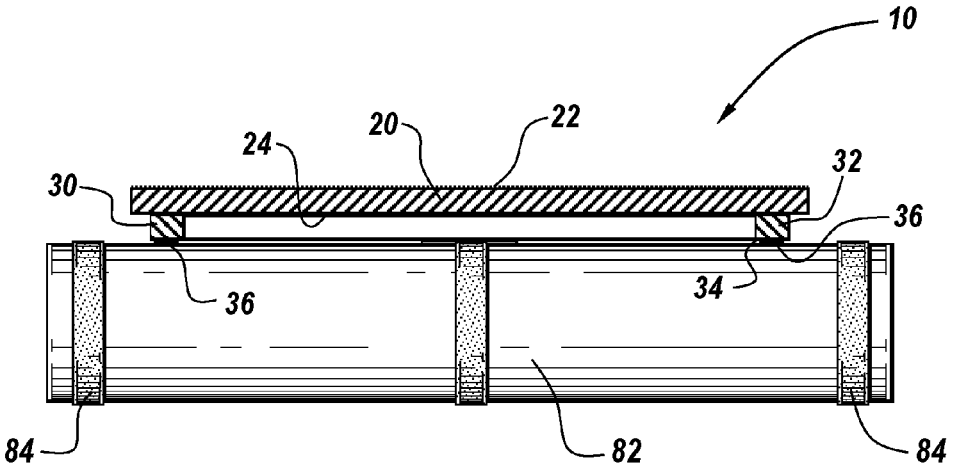
FIG. 4 is a cross-sectional front view illustration of the balance board of FIG. 1 along the line 4-4 with a cylindrical balance tube, in accordance with the first exemplary embodiment of the present disclosure.
Figure 7:
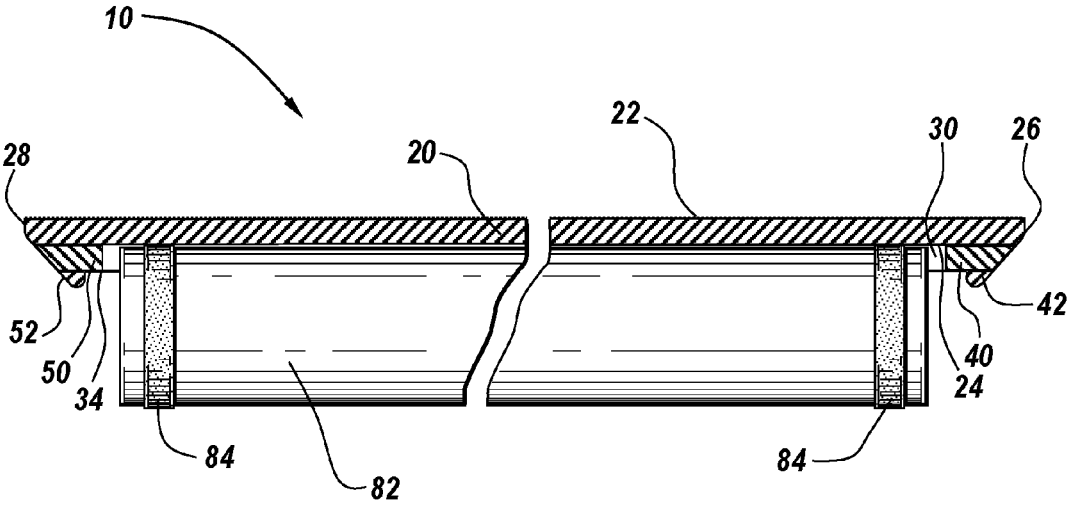
FIG. 7 is a cross-sectional side view illustration of the balance board of FIG. 1 along the line 5-5 with a cylindrical balance tube, in accordance with the first exemplary embodiment of the present disclosure.
Figure 6:
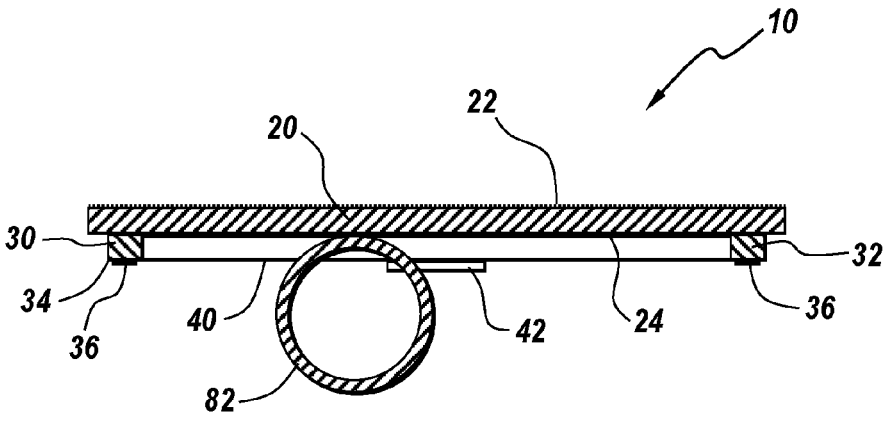
FIG. 6 is a cross-sectional front view illustration of the balance board of FIG. 1 along the line 4-4 with a cylindrical balance tube, in accordance with the first exemplary embodiment of the present disclosure.
Figure 5:
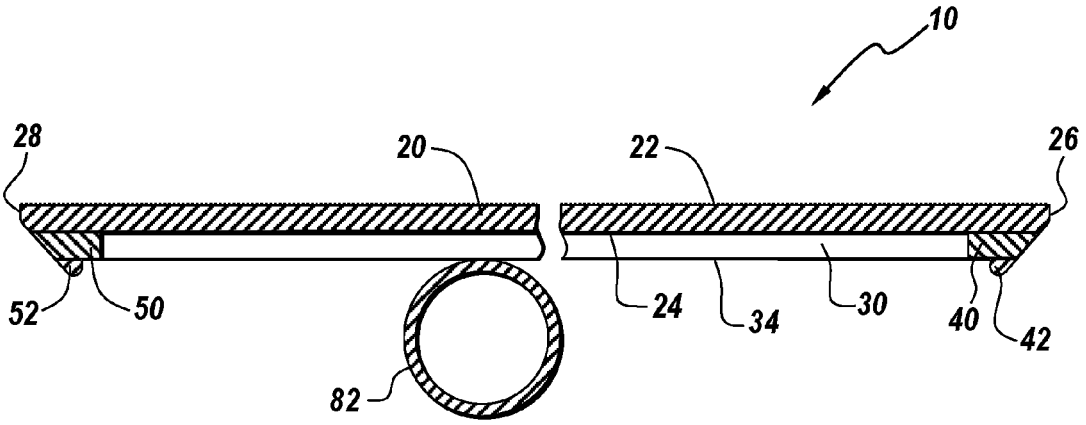
FIG. 5 is a cross-sectional side view illustration of the balance board of FIG. 1 along the line 5-5 with a cylindrical balance tube, in accordance with the first exemplary embodiment of the present disclosure.

The operation and use of the apparatus 10 with a balance device 80, using the cylindrical balance tube 82 as an example, is described relative to FIGS. 1-7. The balance device 80 may be removably positioned in contact with at least one of the bottom surface 24 of the board 20 and the bottom surface 34 of the first rail 30, the second rail 32, the nose cap 40, and the tail cap 50. FIG. 4 is a cross-sectional front view illustration of the balance board 10 of FIG. 1 along the line 4-4 with a cylindrical balance tube 82, in accordance with the first exemplary embodiment of the present disclosure. FIG. 5 is a cross-sectional side view illustration of the balance board 20 of FIG. 1 along the line 5-5 with a cylindrical balance tube 82, in accordance with the first exemplary embodiment of the present disclosure. FIG. 6 is a cross-sectional front view illustration of the balance board 20 of FIG. 1 along the line 4-4 with a cylindrical balance tube 82, in accordance with the first exemplary embodiment of the present disclosure. FIG. 7 is a cross-sectional side view illustration of the balance board 20 of FIG. 1 along the line 5-5 with a cylindrical balance tube 82, in accordance with the first exemplary embodiment of the present disclosure.

FIGS. 4-7 depict various configurations of the board 20 in use with the cylindrical balance tubes 82. For example, as is shown in FIGS. 4-5, the cylindrical balance tube 82 is positioned under each of the first and second rails 30, 32, such that the board 20 is resting fully on the cylindrical balance tube 82. In this configuration, the bottom surface 34 of the first and second rails 30, 32 may contact an exterior surface of the cylindrical balance tube 82. As is shown in FIG. 4, the bottom surface 34 of the first and second rails 30, 32 may be coated with a gripping material 36, which can be a natural or man-made, thin pliable, traction coating to provide a non-slip, non-marring and cushioning surface to interface between the cylindrical balance tube 82 and the first and second rails 30, 32, thereby providing an enhanced grip and smooth, slightly slowed rolling action, and protective barrier between the structures.

Relative to FIG. 5, in use of the apparatus 10, the cylindrical balance tube 82 is movable along a length of the board 20 between the front and rear ends 26, 28, until contact is achieved between the cylindrical balance tube 82 and the nose and tail stops 42, 52. Thus, a user can balance on the top surface 22 of the board 20, shifting his or her weight to move the board 20 relative to the cylindrical balance tube 82. When the cylindrical balance tube 82 reaches an end of the board 20 and contacts one of the nose or tail stops 42, 52, the cylindrical balance tube 82 will be prevented from rolling further along the first and second rails 32, 30. Thus, the nose stop 42 or tail stop 52 may provide a limit to the movement of the cylindrical balance tube 82 when used on the lateral axis, thus reducing the likelihood of a cylindrical balance tube 82 coming away and out from under the board 20 while in use. Various exercises, positions, and techniques can be employed to successfully balance on the board 20 in this position on the cylindrical balance tube 82.

FIGS. 6-7 illustrate a similar situation where the board 20 is used with the cylindrical balance tube 82, however in these figures, the cylindrical balance tube 82 is positioned in contact with the bottom surface 24 of the board 20 itself, e.g., within the center cavity of the board 20, and the cylindrical balance tube 82 is rolled between the first and second rails 30, 32. The cylindrical balance tube 82 can be moved between the first and second rails 30, 32 using the same balance techniques as described relative to FIG. 5, where the first and second rails 30, 32 provide a stop for the cylindrical balance tube 82 when used longitudinally to inhibit the continued lateral movement of the board 20 atop of a cylindrical balance tube 82. Alternatively, the cylindrical balance tube 82 can be used between the nose and tail caps 40, 50 with the cylindrical balance tube 82 contacting the bottom surface 24 of the board 20 (FIG. 6 illustrates the nose cap 40 and nose stop 42 positioned behind the cylindrical balance tube 82).

The apparatus 10 may include multiple cylindrical balance tubes 82 of varying lengths and diameters to provide users of any skill level from beginner to professional athletes, thereby providing a graduated training system for skill proficiency development on multiple axes of balance control. The apparatus 10 may further include balance devices that include other, non-cylindrical roller devices. For example, a 360 degree rotating balance disc 90 or a balance cushion 97 may be used alone or with other parts of the apparatus 10 to promote a true multi-dimensional training experience.

Figure 8A:
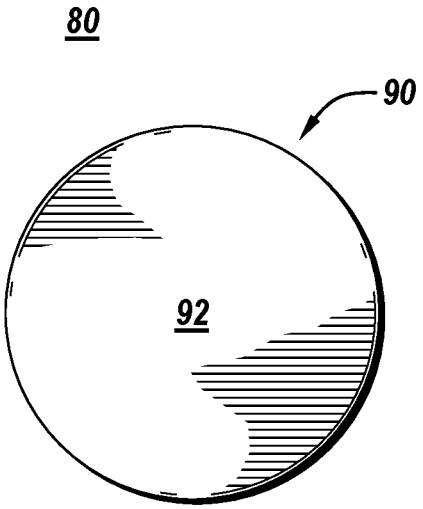
FIG. 8A is a top view illustration of a rotating balance disc, in accordance with the first exemplary embodiment of the present disclosure.
Figure 8B:
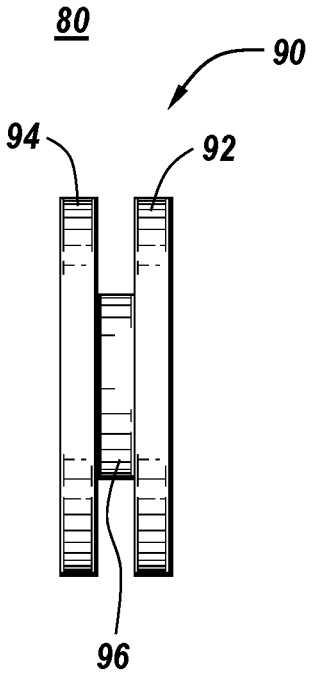
FIG. 8B is a side view illustration of a rotating balance disc, in accordance with the first exemplary embodiment of the present disclosure.
Figure 9:
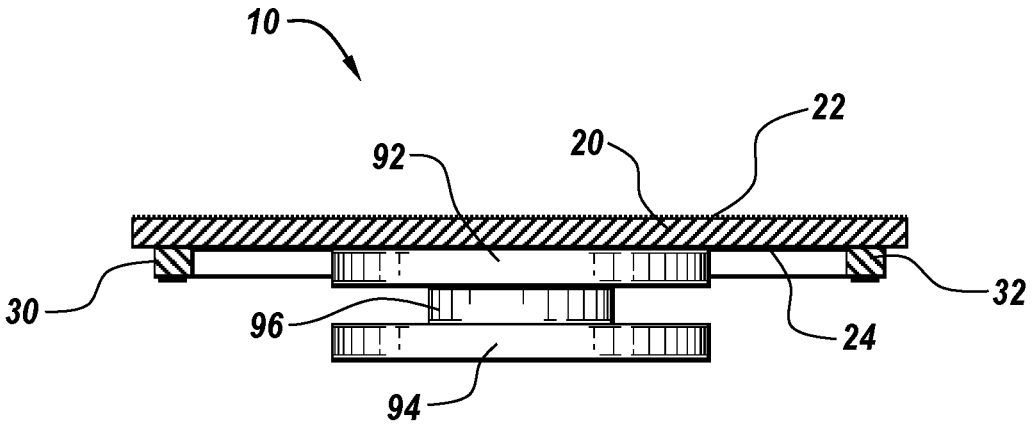
FIG. 9 is a cross-sectional front view illustration of the balance board of FIG. 1 along the line 4-4 with a rotating balance disc, in accordance with the first exemplary embodiment of the present disclosure.

FIG. 8A is a top view illustration of a rotating balance disc 90, in accordance with the first exemplary embodiment of the present disclosure. FIG. 8B is a side view illustration of a rotating balance disc 90, in accordance with the first exemplary embodiment of the present disclosure. FIG. 9 is a cross-sectional front view illustration of the balance board 20 of FIG. 1 along the line 4-4 with a rotating balance disc 90, in accordance with the first exemplary embodiment of the present disclosure. Relative to FIGS. 8A-9, the rotating balance disc 90 may be formed from a top disc 92, a bottom disc 94, and a bearing device 96 positioned therebetween. The rotating balance disc 90 may have a substantially circular footprint and provide 360 degree rotation between the top and bottom discs 92, 94. The rotating balance disc 90 is preferably constructed of wood, plastic, metal or other rigid or semi-rigid material that can be smooth on the top and the edges can be smooth and slightly rounded. The rotating balance disc 90 may be between 6 inches and 20 inches in diameter, although other sizes are permissible. The top and bottom discs 92, 94 are separated by and affixed to the bearing device 96, which may be a rotating ball bearing device, commonly known as a "lazy Susan." The bearing device 96 can be made of a rigid material such as steel, aluminum, hard plastics and similar materials. The bearing device 96 can be built into the top and/or bottom discs 92, 94, or can be separately constructed and affixed by common fasteners such as screws to the top and bottom discs 92, 94. The 360 degree rotation of the rotating balance disc 90 may allow for the board 20 to rotate 360 degrees when placed atop of the rotating balance disc 90. The board 20 may be used alone with the rotating balance disc 90, or in conjunction with any of the other balance devices 80. A preferred configuration is to use the board 20 atop a balance cushion 97 which rests atop of the rotating balance disc 90.

Figure 10A:
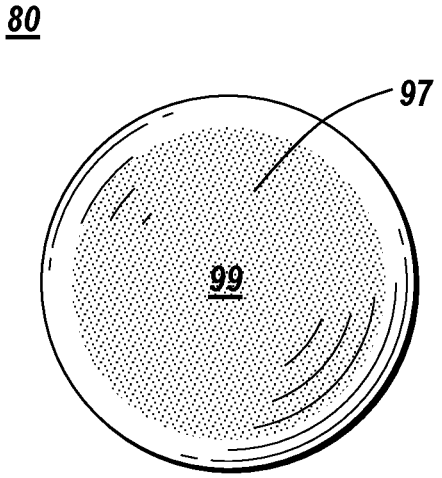
FIG. 10A is a top view illustration of an inflatable balance cushion, in accordance with the first exemplary embodiment of the present disclosure.
Figure 10B:
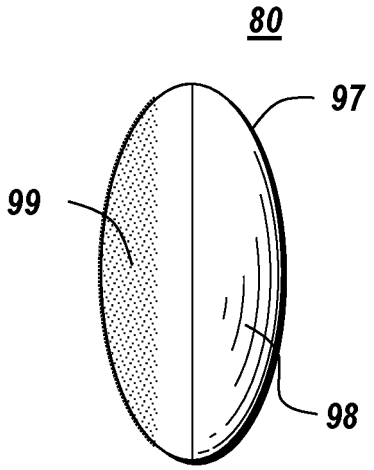
FIG. 10B is a side view illustration of an inflatable balance cushion, in accordance with the first exemplary embodiment of the present disclosure.
Figure 11:
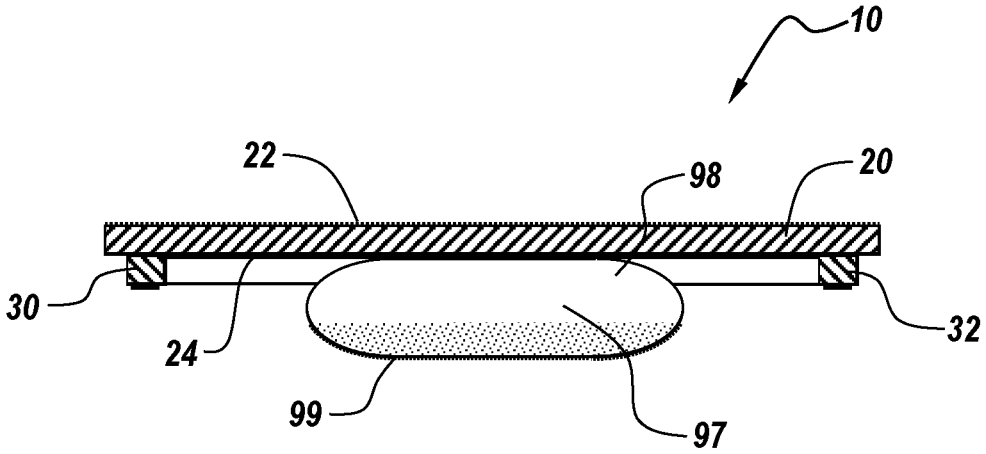
FIG. 11 is a cross-sectional front view illustration of the balance board of FIG. 1 along the line 4-4 with an inflatable balance cushion, in accordance with the first exemplary embodiment of the present disclosure.

FIG. 10A is a top view illustration of an inflatable balance cushion 97, in accordance with the first exemplary embodiment of the present disclosure. FIG. 10B is a side view illustration of an inflatable balance cushion 97, in accordance with the first exemplary embodiment of the present disclosure. FIG. 11 is a cross-sectional front view illustration of the balance board 20 of FIG. 1 along the line 4-4 with an inflatable balance cushion 97, in accordance with the first exemplary embodiment of the present disclosure. The inflatable balance cushion 97 may be formed from a pliable material that holds a small amount of air pressure such as PVC, plastic, urethane or similar semi durable materials that can be inflated and deflated by any device, such as by mouth or by a pump device. The top 98 and the bottom 99 of the inflatable balance cushion 97 can be textured, smooth or a combination of the two. The inflatable balance cushion 97 may be positioned under the board 20 and used in the manners described previously, except that the inflatable balance cushion 97 may provide a more stable balancing situation as compared to cylinders or rotating devices.

Figure 12:
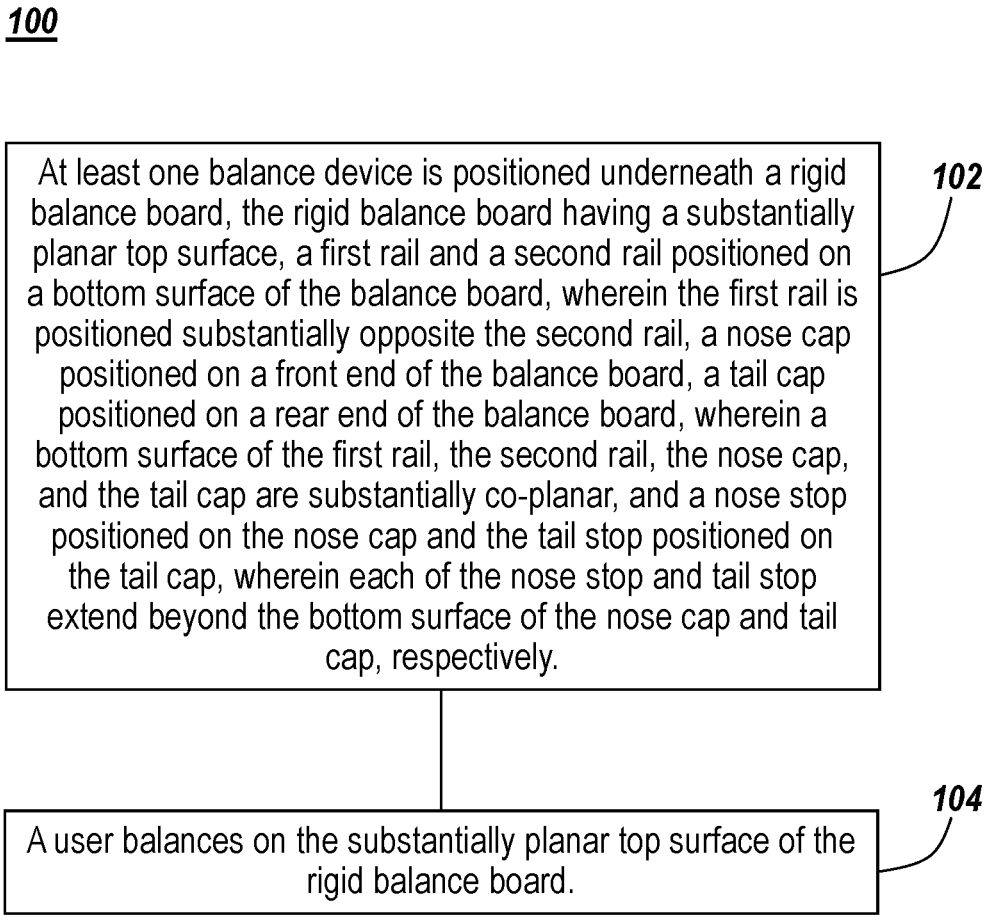
FIG. 12 is a flowchart illustrating a method for balance training exercise, in accordance with the first exemplary embodiment of the present disclosure.

FIG. 12 is a flowchart 100 illustrating a method for balance training exercise, in accordance with the first exemplary embodiment of the present disclosure. It should be noted that any process descriptions or blocks in flow charts should be understood as representing modules, segments, portions of code, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 102, at least one balance device is positioned underneath a rigid balance board, the rigid balance board having a substantially planar top surface, a first rail and a second rail positioned on a bottom surface of the balance board, wherein the first rail is positioned substantially opposite the second rail, a nose cap positioned on a front end of the balance board, a tail cap positioned on a rear end of the balance board, wherein a bottom surface of the first rail, the second rail, the nose cap, and the tail cap are substantially co-planar, and a nose stop positioned on the nose cap and a tail stop positioned on the tail cap, wherein each of the nose stop and tail stop extend beyond the bottom surface of the nose cap and tail cap, respectively. A user balances on the substantially planar top surface of the rigid balance board (block 104).

The method may include any number of other steps, methods, or functions, including any disclosed relative to FIGS. 1-11 herein. For example, balancing the user on the substantially planar top surface of the rigid balance board further comprises balancing the user about an axis of the at least one balance device. Balancing may also include using a balance device that comprises a durable, rigid, cylindrical tube, wherein the cylindrical tube is rotatable between the nose cap and tail cap. A rotation of the cylindrical tube may be stopped with at least one of the nose cap and tail cap or one of the first rail and the second rail.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An apparatus for balance training exercise comprising:

a rigid balance board having a substantially planar top surface;

a first rail and a second rail positioned on a bottom surface of the balance board, wherein the first rail is positioned substantially opposite the second rail;

a nose cap positioned on a front end of the balance board, and a tail cap positioned on a rear end of the balance board, wherein the first rail, the second rail, the nose cap, and the tail cap each have a bottom surface distal to the bottom surface of the balance board, wherein the bottom surfaces of the first rail, the second rail, the nose cap, and the tail cap are substantially co-planar; and a nose stop positioned on the nose cap and a tail stop positioned on the tail cap, wherein each of the nose stop and the tail stop extends beyond the bottom surface of the nose cap and the tail cap, respectively; and wherein the apparatus is configured to be removably positioned in contact with at least one balance device such that a user may balance on the rigid balance board relative to movement of the rigid balance board.

2. The apparatus for balancing training exercise of claim 1, further comprising a center cavity positioned between the first rail, the second rail, the nose cap, and the tail cap.

3. The apparatus for balancing training exercise of claim 1, further comprising a traction coating positioned on the substantially planar top surface.

4. The apparatus for balancing training exercise of claim 1, wherein the tail cap has a flattened rear edge.

5. The apparatus for balancing training exercise of claim 1, further comprising a compressible, gripping material applied to the bottom surface of the first rail and the second rail.

6. The apparatus for balancing training exercise of claim 1, wherein the nose stop and the nose cap share a front edge, wherein the front edge forms an acute angle relative to the substantially planar top surface.

7. The apparatus for balancing training exercise of claim 1, wherein the tail stop and the tail cap share a rear edge, wherein the rear edge forms an acute angle relative to the substantially planar top surface.

8. The apparatus for balancing training exercise of claim 1, wherein at least a portion of each of the first rail and the second rail are positioned a spaced distance interior of first and second elongated edges, respectively, of the rigid balance board.

9. A system for balance training exercise comprising:

a rigid balance board having a substantially planar top surface and a substantially planar bottom surface distal to the top surface;

a first rail positioned on the bottom surface of the balance board, wherein the first rail has a bottom surface distal to the bottom surface of the balance board;

a second rail positioned on the bottom surface of the balance board opposite the second rail, wherein the second rail has a bottom surface distal to the bottom surface of the balance board;

a nose cap positioned on a front end of the balance board, wherein the nose cap has a bottom surface distal to the bottom surface of the balance board;

a tail cap positioned on a rear end of the balance board, wherein the tail cap has a bottom surface distal to the bottom surface of the balance board, wherein the bottom surface of the first rail, the bottom surface of the second rail, the bottom surface of the nose cap, and the bottom surface of the tail cap are co-planar;

a nose stop positioned on the nose cap and a tail stop positioned on the tail cap, wherein each of the nose stop and the tail stop extends beyond the bottom surface of the nose cap and the tail cap, respectively; and at least one balance device configured to be removably positioned in contact with at least one of:

the bottom surface of the balance board; and the bottom surface of at least one of the first rail, the second rail, the nose cap, and the tail cap.

10. The system for balance training exercise of claim 9, wherein the at least one balance device further comprises at least one of:

a durable, rigid, cylindrical tube;

a rotating disc; and an inflatable balance cushion.

11. The system for balance training exercise of claim 10, wherein the durable, rigid, cylindrical tube further comprises a traction material positioned axially about the cylindrical tube.

12. The system for balance training exercise of claim 10, wherein the rotating disc further comprises:

an upper disc;

a base; and a ball-bearing assembly connected between the upper disc and the base, wherein the upper disc is rotatable relative the base.

13. The system for balance training exercise of claim 10, wherein the inflatable balance cushion has a smooth first side and a textured second side.

14. The system for balance training exercise of claim 10, wherein the durable, rigid, cylindrical tube has a length dimension less than a dimension between the nose cap and the tail cap.

15. A method for balance training exercise, the method comprising the steps of:

positioning at least one balance device underneath a rigid balance board, the rigid balance board having a substantially planar top surface, a first rail and a second rail positioned on a bottom surface of the balance board, wherein the first rail is positioned substantially opposite the second rail, a nose cap positioned on a front end of the balance board, a tail cap positioned on a rear end of the balance board, wherein the first rail, the second rail, the nose cap, and the tail cap each have a bottom surface distal to the bottom surface of the balance board, wherein the bottom surfaces of the first rail, the second rail, the nose cap, and the tail cap are substantially co-planar, and a nose stop positioned on the nose cap and a tail stop positioned on the tail cap, wherein each of the nose stop and the tail stop extends beyond the bottom surface of the nose cap and the tail cap, respectively; and balancing a user on the substantially planar top surface of the rigid balance board.

16. The method of claim 15, wherein the at least one balance device further comprises a durable, rigid, cylindrical tube, wherein the cylindrical tube is rotatable between the nose cap and tail cap.

17. The method of claim 16, further comprising the step of stopping a rotation of the cylindrical tube with at least one of the nose cap and tail cap.

18. The method of claim 15, wherein the at least one balance device further comprises a durable, rigid, cylindrical tube, wherein the cylindrical tube is rotatable between the first rail and the second rail.

19. The method of claim 18, further comprising the step of stopping a rotation of the cylindrical tube with at least one of the first rail and the second rail.

20. The method of claim 15, wherein the step of balancing the user on the substantially planar top surface of the rigid balance board further comprises balancing the user about an axis of the at least one balance device.

* * * * *